United States Patent [19]

Booth et al.

[11] Patent Number: 4,653,954

[45] Date of Patent: Mar. 31, 1987

[54] APPARATUS FOR MOVING A TRAFFIC BARRIER

[76] Inventors: William L. Booth, 300 Napa St., Sausalito, Calif. 94965; Leslie S. Stone, 33 Barranca Rd., Forest Knolls, Calif. 94933

[21] Appl. No.: 806,624

[22] Filed: Dec. 9, 1985

[51] Int. Cl.[4] ..... E01F 13/00

[52] U.S. Cl. ..... 404/6; 404/9; 404/12

[58] Field of Search ..... 404/6, 9, 12, 13; 116/63 P; 256/13.1

[56] References Cited

U.S. PATENT DOCUMENTS

| | | | |
|---|---|---|---|
| 2,931,279 | 4/1960 | Wiswell | 404/13 |
| 4,017,200 | 4/1977 | Wood, Jr. | 404/6 |
| 4,474,503 | 10/1984 | Booth et al. | 404/6 |
| 4,498,803 | 2/1985 | Quittner | 404/6 |
| 4,500,225 | 2/1985 | Quittner | 404/6 |

FOREIGN PATENT DOCUMENTS

| | | | |
|---|---|---|---|
| 2562575 | 10/1985 | France | 404/12 |
| 2562576 | 10/1985 | France | 256/13.1 |
| 43-17548 | 7/1968 | Japan | 404/9 |

*Primary Examiner*—James A. Leppink
*Assistant Examiner*—Matthew Smith
*Attorney, Agent, or Firm*—Melvin R. Stidham

[57] ABSTRACT

Disclosed is apparatus for moving laterally a traffic control barrier having a plurality of pivotally linked sections. The transfer vehicle includes means for picking up the sections on one side and depositing them on the other side as it moves along the roadway. The vehicle has front and rear guide drums around which the sections are moved through the vehicle in an S-shaped path and there are means for varying the space between the axes of the guide drums to compensate for disparity in lengths of the lane dividers around a curved roadway.

5 Claims, 15 Drawing Figures

APPARATUS FOR MOVING A TRAFFIC BARRIER

BACKGROUND OF THE INVENTION

Principal features of this invention are shown in Disclosure Document No. 132,925 filed Dec. 3, 1984.

This invention relates to traffic control systems wherein means are provided to separate adjacent lanes of a roadway to facilitate movement of traffic in opposite directions. Generally, two-way roadways are marked with a center stripe or provided with a median barrier to provide an equal number of traffic lanes available to flow of traffic in each direction. This is satisfactory during most periods but it is highly desirable to be able to increase the number of traffic lanes to accommodate the increased flow of traffic in one direction or the other during peak commuting hours in urban areas. One system, commonly used, involves the placement of hollow cones or tubular cylinders along lane dividers to provide a more visible separator between lanes wherein traffic flows in opposite directions. Such separators must be moved one at a time and before and after each peak traffic period and constitute little more than a visual traffic separator. They do not constitute a barrier to encroachment of vehicles into oncoming traffic lanes and, when struck by a vehicle, could be projected into lanes of moving traffic.

Other solutions, such as shown in U.S. Pat. Nos. 3,391,620 and 4,004,857 involve the movement of lightweight barriers transversely across the roadway from one lane divider to another. However, such systems require that modifications be made to the roadway and are, therefore, relatively expensive. Moreover, such lightweight barriers do not constitute a substantial barrier to head-on collisions and may, themselves, cause damage if struck by an automobile.

Another system, shown in U.S. Pat. No. 3,958,890 provides for the movement of heavy, substantial divider sections transversely across the roadway, but such system requires the permanent installation of crossbeams supported on columns which, in turn, support the hoists required to lift the sections. Other systems requiring permanent and expensive installations are shown in U.S. Pat. Nos. 2,182,697 and 2,287,685.

A transfer vehicle for moving a chain of units forming a "center-line" is shown in U.S. Pat. No. 2,931,279.

In our previous U.S. Pat. No. 4,474,503, we proposed a traffic barrier that comprises a chain of relatively heavy sections hinged together. A transfer vehicle includes trolley wheels that lift the barrier, section by section, and move it diagonally across the vehicle to deposit it along the next adjacent lane divider. Such apparatus appears to be workable for straight roadways, but serious problems would be encountered on curved roadways where the lane dividers around the curve are of different arcuate lengths. That is, for each unit of distance traversed by the vehicle, it would normally deposit the same length of barrier as it picks up, whereas on a curved roadway, the length of barrier required to be deposited may be shorter or longer than that picked up.

OBJECTS OF THE INVENTION

It is an object of this invention to provide a movable traffic barrier which, when in place, is sufficiently fixed to prevent head-on collisions.

It is a further object of this invention to provide an elongated barrier comprising a chain of pivoted heavy sections, together with apparatus for moving the chain from one lane divider to the next, even around a curve, and even if the lane width flares or diminishes.

It is a further object of this invention to provide a transfer vehicle that can pick up a segmented traffic barrier chain from a lane divider and deposit it section by section along the next lane divider while compensating for any disparity in length in arcuate lane dividers around a curve in the road.

Other objects and advantages of this invention will become apparent from the description to follow, particularly when read in conjunction with the accompanying drawings.

SUMMARY OF THE INVENTION

In carrying out this invention, we provide a traffic barrier comprising an elongated chain of heavy sections pivoted together to be placed along a lane divider of a multiple lane roadway or along the edge of a roadway. Each section of the barrier comprises a heavy base from which there extends a vertical web with a horizontal top flange, forming a Tee. Each section is pivoted to the next to enable relative pivotal movement about a vertical axis and to allow a certain amount of movement about a horizontal axis. A locking cap or rail comprises a series of linked, inverted channels that fit over the top flanges of the sections to prevent pivotal movement thereof when in place on the roadway.

The transfer vehicle moves along the traffic lane lifting the traffic barrier chain on one side, section by section, while laying the chain down along the next lane divider on the other side of the vehicle. A plurality of trolley wheels of progressively increasing elevation engage under the top flange or Tee of the barrier sections so that the barrier rides up the series of trolley wheels and onto a roller conveyor platform. Leaving the other side of the vehicle, the barrier chain rides down a similar series of trolley wheels to settle gradually onto the roadway, one lane displaced. On the vehicle are fore and aft guide drums, and the barrier chain passes around one drum and then back around the other drum in an S-shaped path, before being lowered by the trolley wheels onto the roadway. The guide drums are movable longitudinally of the transfer vehicle to vary the length of barrier caried aboard, so that any additional sections required to be deposited on the larger arc of a curve may be made up by moving the guide wheels closer together and any excess sections when depositing around a smaller arc are absorbed by separating the guide wheels, thus retaining them on the transfer vehicle.

DESCRIPTION OF A PREFERRED EMBODIMENT

Figure 1:
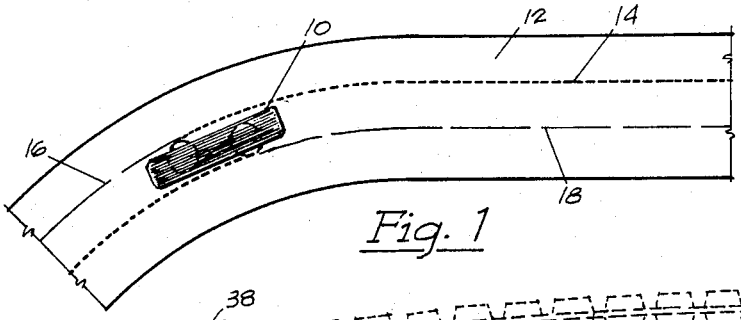
FIG. 1 is a reduced plan view showing the method of operation of the present invention.
Figure 2:
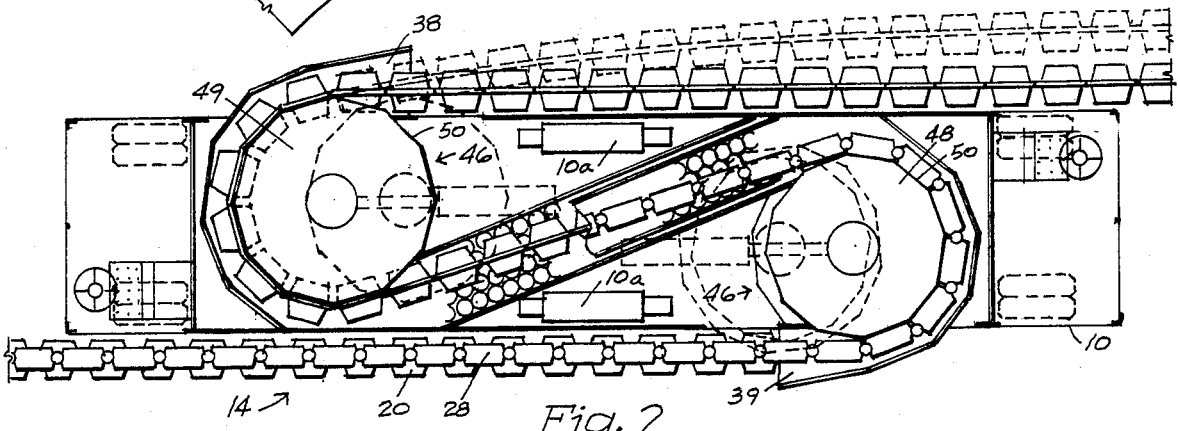
FIG. 2 is a horizontal section view through the transfer vehicle of this invention.
Figure 3:
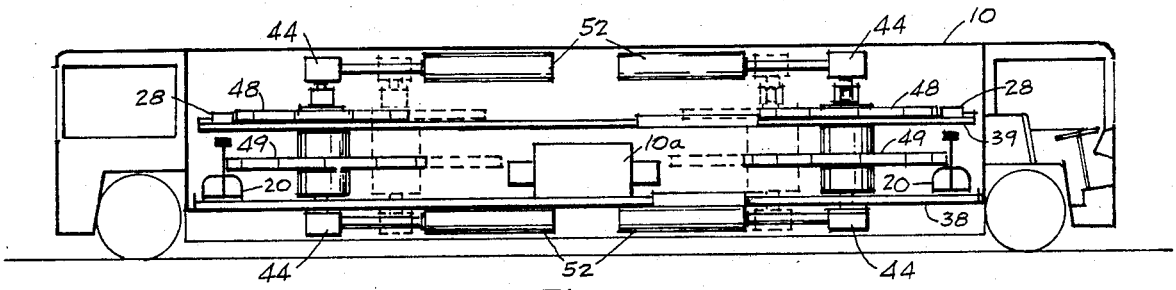
FIG. 3 is a vertical section through the transfer vehicle.
Figure 4:
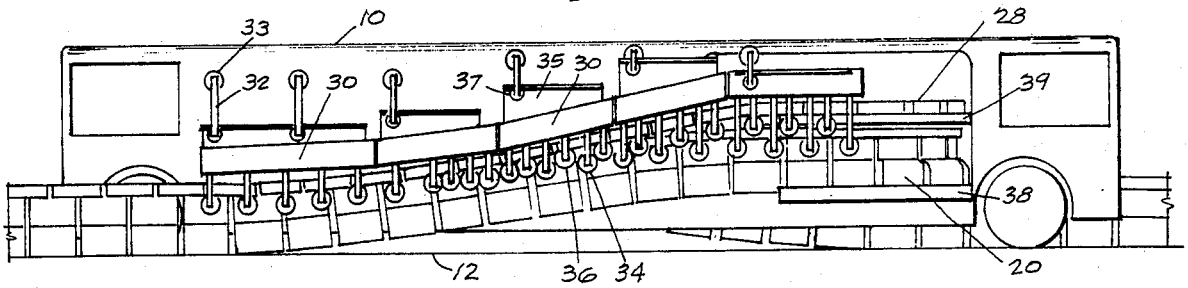
FIG. 4 is a side elevation of the transfer vehicle in operation.
Figure 5:
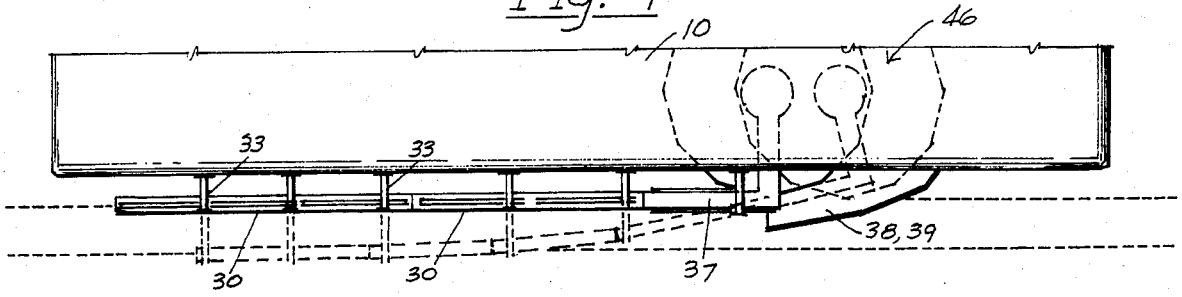
FIG. 5 is a partial plan of the transfer vehicle, showing the articulated trolley track arm.

Referring now to FIG. 1 with greater particularity, the transfer vehicle 10 of this invention moves along the roadway 12 and lifts the barrier 14 aboard, section by section or link by link from one lane divider 16, and then deposits it section by section on and along the next adjacent lane divider 18.

Figure 13:
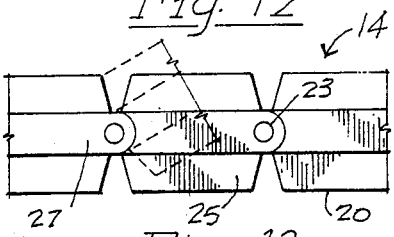
FIG. 13 is a plan view of the barrier units.

Referring to FIGS. 12 to 15, the barrier 14 comprises a plurality of sections 20 hinged together at 22 and 23 to allow a certain amount of relative pivotal movement along a vertical axis as indicated in phantom in FIG. 13 and a limited amount of pivotal movement along a horizontal axis so that each section may be lifted upward relative to the next adjacent section to raise the sections onto the transfer vehicle 10, as will hereinafter be described. Each section 20 comprises a heavy base plate 24, a curb section 25 and an upright Tee section 26 having a top flange 27. The tires of an automotive vehicle can engage the curb portion 25 without damaging the wheels or body. The base 24 may contain a longitudinal slot 24a to seat over lugs L commonly placed along lane dividers 16 or 18. For purposes of rigidity, the chain may also include a series of pivoted channel caps or locking cap rails 28 which engage over the top flange 27 of the barrier sections 20 to prevent pivotal movement thereof when in place on the roadway. The channel sections are pivotally connected at 29 intermediate the barrier section hinges 22 and 23 so that, with the hinges 23 and 29 staggered longitudinally, the sections or links 20 will not pivot or swing out of place under impact.

Figure 8:
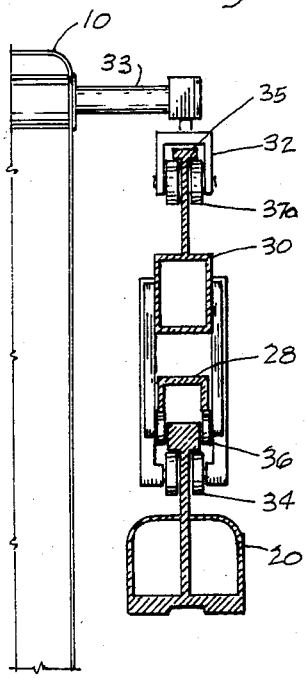
FIG. 8 is a cross-section through trolley and barrier.
Figure 9:
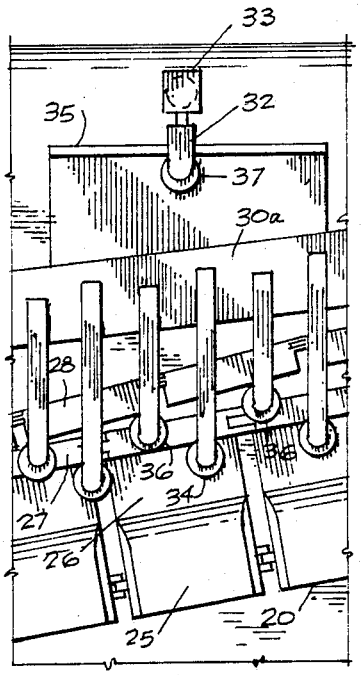
FIG. 9 is a partial elevation of the trolley and barrier.
Figure 14:
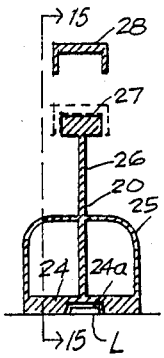
FIG. 14 is a cross-section through a barrier unit.
Figure 15:
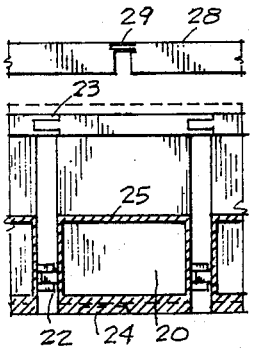
FIG. 15 is a longitudinal section taken along line 15—15 of FIG. 14.

As shown particularly in FIGS. 4, 5, 8 and 9, there are a series of hinged together trolley track arm segments 30 depending from each side of the transfer vehicle 10 and carried on support hanger yokes 32. The hanger yokes 32 are, in turn suspended from extendible support arms 33 (FIG. 8). Trolley wheels 34 carried by the track support arm segments 30 engage under the top flanges 27 of the barrier sections 20 as the transfer vehicle 10, driven by engines 10*a*, moves forwardly along the barrier in place 14. Hence, the linked sections 20 ride up the trolley wheels 34 onto the vehicle 10 as on a ramp. A second series of trolley wheels 36 engage under the inverted channel lock rail sections 28 to separate them from the upper flanges 27 of the barrier sections 20.

On the other side of the transfer vehicle 10, the barrier segments 20 and the segmented lock rail 28 are gradually moved down along the depending wheels 34 and 36 until they are dropped into place on the roadway 12, separated from the previous barrier by a full traffic lane. The width of the lane between the previous barrier and barrier sections deposited can be adjusted by extension or retraction of the trolley track support arms 33, and by pivoting the trolley/conveyor transfer arm 37 (FIGS. 5 and 6), so that the sections 20 and 28 will be delivered to and from the transfer vehicle 10 along paths which are tangent to the guide drum 46. Sheaves 37*a*, supporting track segments 35, allow the trolley track arm segment 30 to shift longitudinally to accommodate the longitudinal movement of guide drums.

Figure 10:
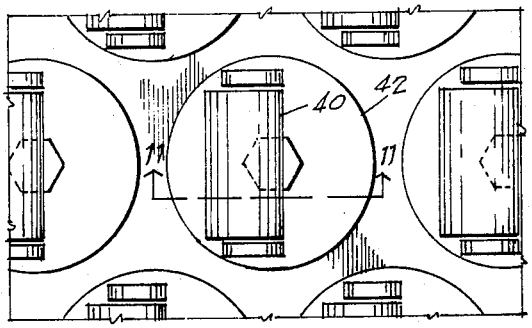
FIG. 10 is a plan detail of the conveyor platform within the transfer vehicle.
Figure 11:
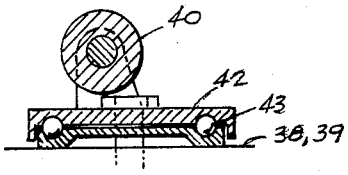
FIG. 11 is a section view taken through line 11—11 of FIG. 10.
Figure 7:
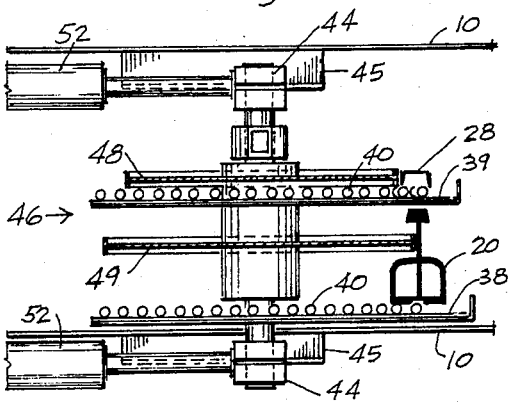
FIG. 7 is a section view taken along line 7—7 of FIG. 6.
Figure 12:
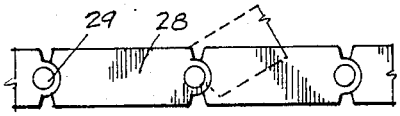
FIG. 12 is a plan view of the barrier locking cap rail.

When the barrier sections 20 are lifted onto the transfer vehicle 10, they are deposited onto a lower transfer platform 38 while the separated channel caps or lock rail sections 28 are deposited onto an upper transfer platform 39. As shown particularly in FIGS. 10 and 11 the transfer platforms 38 and 39 include a plurality of conveyor rollers 40 over which the barrier sections 20 and lock rail sections 28 are easily moved. Each roller 40 is carried on a circular disc 42 that is rotatably mounted on the platform on anti-friction bearings 43. Hence, as the separated sections 20 and 28 move along the conveyor rollers 40, the rollers 40 will "weathervane" by rotation of the discs 42 so that the rollers 40 are deposited normal to the direction of travel.

Figure 6:
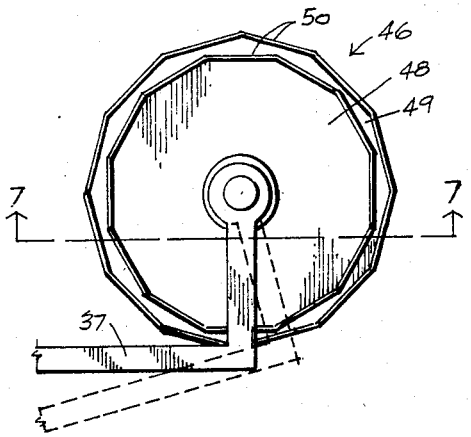
FIG. 6 is a plan view of the barrier guide drum mounted in the transfer vehicle.

Rotatably supported in journals 44 at opposite ends of the transfer vehicle are guide drums 46, each comprising upper and lower faceted wheels 48 and 49. The sides 50 of the polygonal wheels 48 and 49 are sized to accommodate the lengths of the barrier and locking cap rail sections 20 and 28. Hence, as the sections 20 and 28 are pulled along the platforms 38 and 39 they engage and drive the faceted wheels 48 and 49. As shown in FIG. 6, since the sections 20 and 28 are offset by staggering the hinges 23 and 29 the faces of the wheels 48 and 49 are likewise offset.

Each section 20 and 28 engages around a guide drum 46 and then is directed back around the other guide drum 46 to traverse the platforms 38 and 39 in an "S" pattern to be received by the depositing trolley wheels 34 and 36.

The guide drums 46 are moved longitudinally of the transfer vehicle 10 by drum positioning means 52 carrying the journal box 44 slidably attached to the guides 45. Hence, as the barrier 14 is moved around a curve in the roadway 12 from an outer lane divider 16 (FIG. 1) to an inner lane divider 18 on a smaller radius, the drums 46 may be extended to absorb the excess length of barrier.

In operation, the transfer vehicle 10, with a length of barrier sections on board and entrained around guide drums 46 approaches the in-place barrier 14. The first segment of the in-place barrier 14 is detached from its anchoring device and attached to the on-board barrier sections. The vehicle then moves ahead and the on-board segments are forced around the guide drums 46 until the first segment of the repositioned barrier is discharged from the vehicle and is attached to an anchoring device. The trolley wheels 34 engage under the top flanges 27 of each section 20 so that the sections ride up the progressively higher trolley wheels 34 and onto the transfer platform 38. At the same time, the other set of trolley wheels 36 engages under the locking rail so that it is deposited section by section on the upper platform 39. The sections 20 and 28 are guided around the guide drums in the S pattern previously described and then ride down the trolley wheels 34 and 36 on the other side to settle onto the roadway 12. Any difference in arcuate length is absorbed in, or accommodated by, extension or retraction of the guide drums 46. That is, in the event that the sections 20 are being deposited along a longer arcuate path, the guide drums 46 are retracted to bring them closer together so that more sections are available for placement on the roadway. In the event that the sections are being deposited on a shorter curve, the guide drums 46 are separated to absorb the links that are not required for deposition onto the roadway.

As the vehicle approaches the end of the in-place barrier 14, the last barrier section 20 is detached from its anchoring device, and the last section of the repositioned barrier is severed from the on-board chain and attached to its anchoring device. The vehicle is then driven away until time for the next barrier movement. It should be noted that the vehicle is double ended so that it does not have to be turned around.

While this invention has been described in conjunction with a preferred embodiment thereof, it is obvious that modifications and changes therein may be made by those skilled in the art to which it pertains without departing from the spirit and scope of this invention, as defined by the claims appended hereto.

What is claimed as invention is:

1. Apparatus for moving laterally a traffic control barrier having a plurality of pivotally connected sections, each of said sections having a heavy base and, extending upward therefrom, a T-section having top, lateral flange portions;

said apparatus comprising:

a barrier transfer vehicle movable along a roadway traffic lane;

a row of pairs of barrier pick-up trolley wheels depending from one side of said transfer vehicle to engage under said lateral flanges;

front and rear guide drums on said transfer vehicle, whereby said barrier sections are directed around said rear drum and around said front drum along an S-shaped path to the other side of said vehicle; and a row of pairs of barrier depositing trolley wheels depending from the other side of said transfer vehicle to engage under said lateral flanges;

said pick-up trolley wheels being disposed progressively higher from front to rear of said transfer vehicle;

said depositing trolley wheels being disposed progressively lower from front to rear of said transfer vehicle.

2. The apparatus defined by claim 1 including:

means for varying the spacing between the axes of said front and rear guide drums.

3. The apparatus defined by claim 1 including:

means for varying the spacing between said rows of trolley wheels.

4. The apparatus defined by claim 1 including:

means mounting said guide drums for rotation on said transfer vehicle;

said guide drums being polygonal in configuration and each side thereof being substantially equal to the length of one of said barrier sections.

5. The apparatus defined by claim 1 wherein said traffic control barrier includes a plurality of inverted channel members linked together to be received over said lateral flange portions with the linkages thereof intermediate the pivotal connections between said sections, comprising:

a plurality of pairs of channel pick-up trolley wheels depending from said one side of said transfer vehicle and disposed progressively higher from front to rear of said transfer vehicle in the direction of travel;

at least some of said channel pick-up trolley wheels being disposed at a steeper angle than said barrier pick-up trolley wheels;

said channel sections being directed around said rear drum and said front drum along an S-shaped path to the other side of said vehicle; and a plurality of pairs of channel laying trolley wheels depending from the other side of said vehicle.

* * * * *